US005186554A

United States Patent [19]

Mizutani et al.

[11] Patent Number: 5,186,554

[45] Date of Patent: Feb. 16, 1993

[54] INK RIBBON CARTRIDGE

[75] Inventors: Minoru Mizutani; Norihisa Isaka, both of Tokyo, Japan

[73] Assignee: Oki Electric Industry Co., Ltd., Tokyo, Japan

[21] Appl. No.: 829,405

[22] Filed: Feb. 3, 1992

[30] Foreign Application Priority Data

Feb. 13, 1991 [JP] Japan ..... 3-11975[U]

[51] Int. Cl.[5] ..... B41J 35/08

[52] U.S. Cl. ..... 400/247; 400/208

[58] Field of Search ..... 400/247, 248, 248.1, 400/642, 445.1, 207, 208, 250

[56] References Cited

U.S. PATENT DOCUMENTS

| | | | |
|---|---|---|---|
| 4,383,775 | 5/1983 | Trammell et al. | 400/248 |
| 4,422,785 | 12/1983 | Shore | 400/247 |
| 4,753,545 | 6/1988 | Kohlhage et al. | 400/208 |
| 4,773,779 | 9/1988 | Wyne | 400/247 |
| 5,071,272 | 12/1991 | Bell | 400/247 |

FOREIGN PATENT DOCUMENTS 0299225 1/1989 European Pat. Off. .

OTHER PUBLICATIONS

IBM Tech. Disclosure Bulletin vol. 16, No. 3 Aug. 1973 "Detenable Ribbon Shield" Matuck et al.

IBM Tech. Disclosure Bulletin vol. 5, No. 11, Apr. 1963 "Typing Shield" Hosey.

*Primary Examiner*—David A. Wiecking

*Assistant Examiner*—Ren Yan

*Attorney, Agent, or Firm*—Spencer, Frank & Schneider

[57] ABSTRACT

An ink ribbon cartridge has an ink ribbon and a ribbon casing accommodating the ink ribbon therein and defining in a part thereof an ink ribbon exposure opening. A film defining a printing opening therethrough is fixed at lengthwise opposite ends thereof on the ribbon casing by two supports, respectively, while covering the exposure opening. At least one of the two supports is movable along the length of the film.

10 Claims, 12 Drawing Sheets

INK RIBBON CARTRIDGE

BACKGROUND OF THE INVENTION

1) Field of the Invention

This invention relates to an ink ribbon cartridge which is suitable for use with an impact printer and has the function of shielding an ink ribbon and a printing paper sheet from each other by a film so that the printing paper sheet can be protected from ink smear.

2) Description of the Related Art

Ink ribbon cartridges having an ink smear preventing function have been reported to date, including that disclosed in commonly assigned U.S. Pat. No. 4,676,681.

The conventional ink ribbon cartridge described in the above U.S. patent is provided with a film for protecting a printing paper sheet from ink smear. During printing, the film prevents the ink ribbon from accidentally contacting the printing paper sheet so that the printing paper sheet is protected from smear. This conventional ink ribbon cartridge is, however, subject to the problem that the film may contact a printed surface area of the printing paper sheet immediately after its printing and may rub the so-printed ink thereby smearing the printing paper sheet.

SUMMARY OF THE INVENTION

With the foregoing problem in view, the present invention has as a primary object thereof the provision of an ink ribbon cartridge in which a film is prevented from contacting a printed area of a printing paper sheet immediately after its printing so as to protect the printing paper sheet from smear.

It has now been found that the above object can be achieved by holding the film at a position apart from an exposed portion of an ink ribbon before the ink ribbon cartridge has been loaded on a printer and moving the film to a position close to the print head when the ink ribbon cartridge has been loaded on the printer.

This invention, therefore, provides an ink ribbon cartridge having an ink ribbon and a ribbon casing accommodating the ink ribbon therein and defining in a part thereof an ink ribbon exposure opening. A film defining a printing opening therethrough is fixed at lengthwise opposite ends thereof on the ribbon casing by two supports, respectively, while covering the exposure opening. At least one of the two supports is movable along the length of the film.

In a preferred embodiment, the ink ribbon cartridge further comprises a means for normally biasing said at least one support in the direction that the tension of the film is relaxed; and a film-moving means for moving said at least one support against said biasing means upon completion of loading of the ink ribbon cartridge on an impact printer.

Owing to the construction described above, the film is supported at a position apart from an exposed portion of the ink ribbon under the biasing force of the biasing means while the ink ribbon cartridge is not loaded on the printer.

When the ink ribbon cartridge is loaded on the printer, said one support is moved along the direction of the film so that the film is tensioned. As a consequence, the film maintains a predetermined interval from a printing paper sheet set in close contact with the ink ribbon cartridge. The film is prevented from contacting a printed area of the printing paper sheet immediately after its printing, whereby the printed paper sheet is protected from ink smear.

DESCRIPTION OF THE PREFERRED EMBODIMENTS

Figure 1:
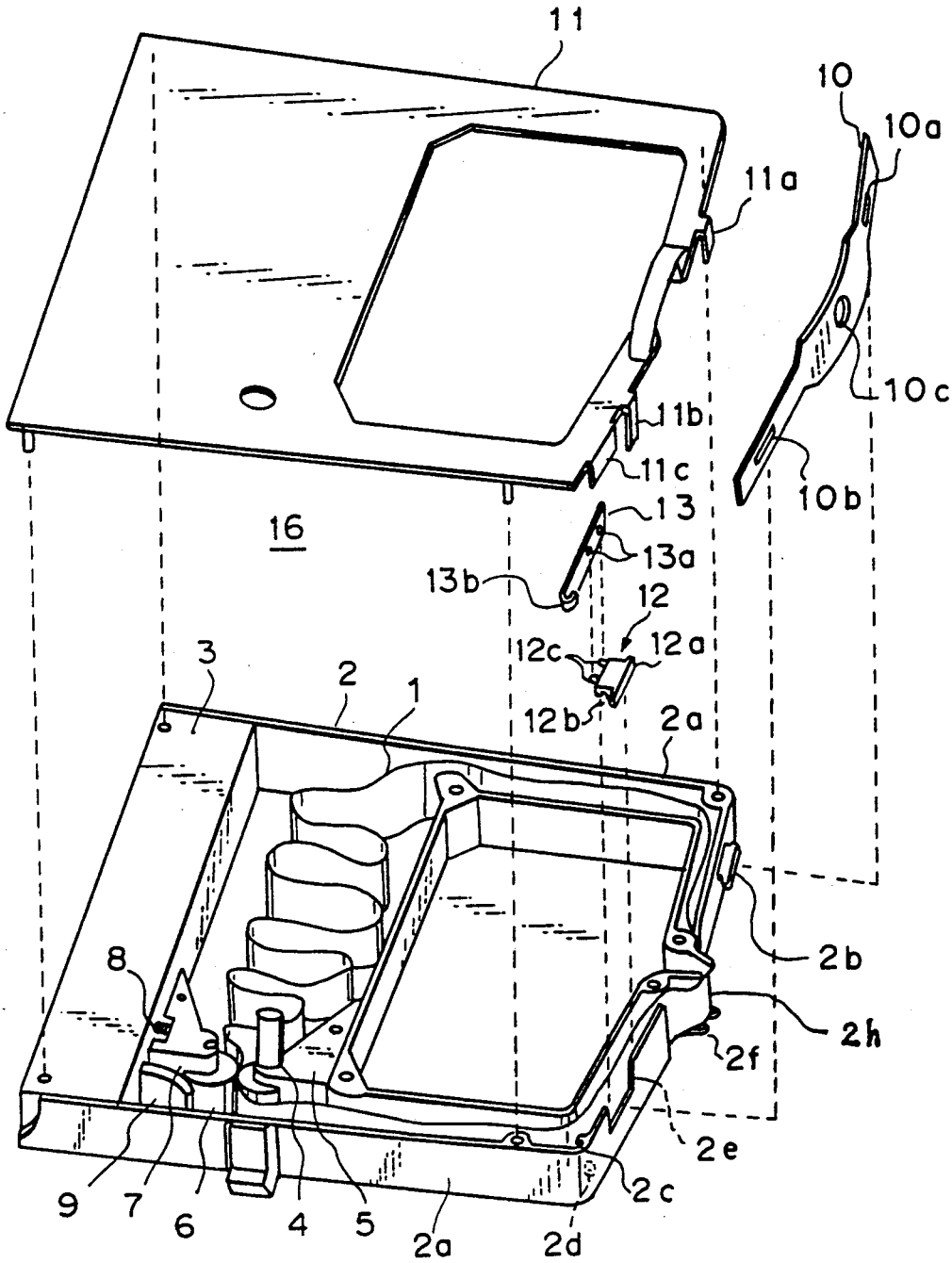
FIG. 1 is an exploded perspective view of an ink ribbon cartridge according to a first embodiment of this invention.

The embodiments will hereinafter be described with reference to the accompanying drawings, in which like elements of structure are identified by like reference numerals or symbols.

With reference to FIG. 1, the ink ribbon cartridge according to the first embodiment of this invention designated at numeral 16 will be described first. An endless ink ribbon 1 is accommodated within a ribbon casing 2 so that the ink ribbon 1 is externally exposed only at a printing position. An ink tank 3 is provided to replenish ink to the ink ribbon 1 and accommodates felt soaked with replenishing ink. A feed gear 4 and an idle gear 6, which is arranged opposite to the feed gear 4, hold the ink ribbon 1 therebetween. The feed gear 4 is held for rotation by a feed gear holder 5 and is rotated by drive force transmitted thereto from an unillustrated motor on a side of a printer (not shown). Clockwise rotation of the feed gear 4 causes the idle gear 6 to rotate counterclockwise, whereby the ink ribbon 1 is recirculated along paired arm-like ribbon guides 2a,2a within the ribbon casing 2.

A coil spring 8 is arranged in a compressed state, with one end secured on the ink tank 3 and the other attached to an idle gear holder 7. The idle gear 6 and feed gear 4 can hold the ink ribbon 1 owing to the compression force of the coil spring 8.

An ink-feeding member 9 is accommodated with one end maintained in contact with the idle gear 6 and the other and kept in contact with the unillustrated felt contained inside the ink tank 3. The idle gear 6, therefore, play the role that, upon rotation, it receives ink from the ink-feeding member 9 and feeds the ink to the ink ribbon 1.

The film 10 covers an exposed portion of the ink ribbon 1, said exposed portion being located in an ink ribbon exposure opening 2h which is formed between both the ribbon guides 2a,2a. The film 10 defines rectangular slots 10a,10b in opposite end portions thereof. These slots 10a,10b are fitted on a film support portion 2b of the ribbon casing 2 and a film-fixing hook 12a of a below-described film support member 12, whereby the film 10 is supported covering the exposed portion of the ink ribbon 1. The film 10 also defines a printing hole 10c at a position which, when the ink ribbon cartridge 16 has been loaded on the printer, is opposite to a free end portion of a print head, so that print wires of the print head can impact the ink ribbon 1 against a printing paper sheet through the printing hole 10c. The film 10 serves to prevent the ink ribbon 1 from contacting the printing paper sheet while the ink ribbon 1 is not impacted by the print wires upon printing.

The film support member 12 has the film-fixing hook 12a for the film 10, an engagement slot 12b having an inverted, square U-shaped cross-section and being engageable with the ribbon casing 2 so that the film support member 12 is movable back and forth along the length of the film 10, and projections 12c,12c fitted in holes 13a,13a formed in a leaf spring 13 as a biasing means. The leaf spring 13 has a hook 13b for fixing the leaf spring 13 on the ribbon casing 2.

The film support member 12 and leaf spring 13 can be attached to the ribbon casing 2 by inserting the projections 12c,12c into the holes 13a,13a, bringing the engagement slot 12b into engagement with the rail portion 2e which has been formed by cutting off the ribbon casing 2 in the form of an inverted square U-shape, and then also bringing the hook 13b of the leaf spring 13 into engagement with a leaf-spring-fixing hook 2c of the ribbon casing 2.

An upper cover 11 is attached to the ribbon casing 2 by press-fitting pins. Lugs 11a,11b are provided to prevent the film 10 from dropping from the ribbon casing 2. A further lug 11c is shaped so that it fits an upper portion of the rail portion 2e of the ribbon casing 2. By the attachment of the upper cover 11 to the ribbon casing 2, the lug 11c is fitted on the rail portion 2e to prevent the film support member 12 from dropping from the ribbon casing 2. Further, a bottom hole 2d is formed through the bottom wall of the ribbon casing 2 at a position adjacent the rail portion 2e.

In addition, the ribbon casing 2 is also provided with a ribbon guide 2f at a position adjacent the ink ribbon exposure opening 2h. The ribbon guide 2f serves to guide recirculation of the ink ribbon 1 and prevents mutual contact between the ink ribbon 1 and the film 10.

Figure 2:
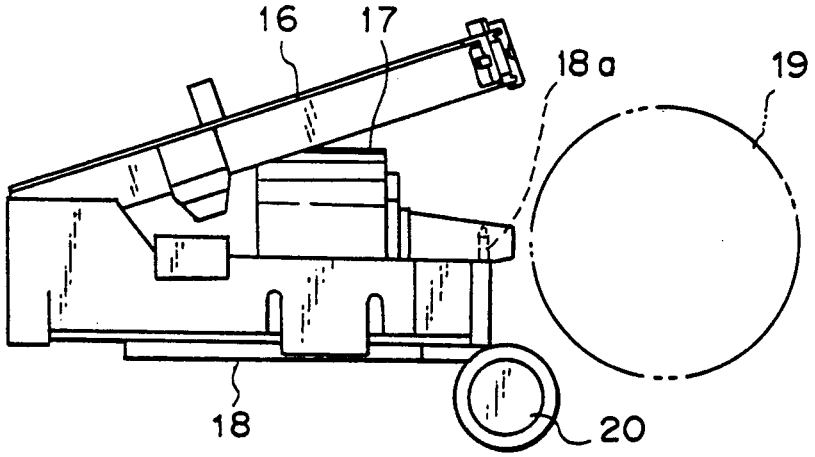
FIG. 2 is a schematic side view of the ink ribbon cartridge of the first embodiment, showing the manner of its loading on a printer.
Figure 3:
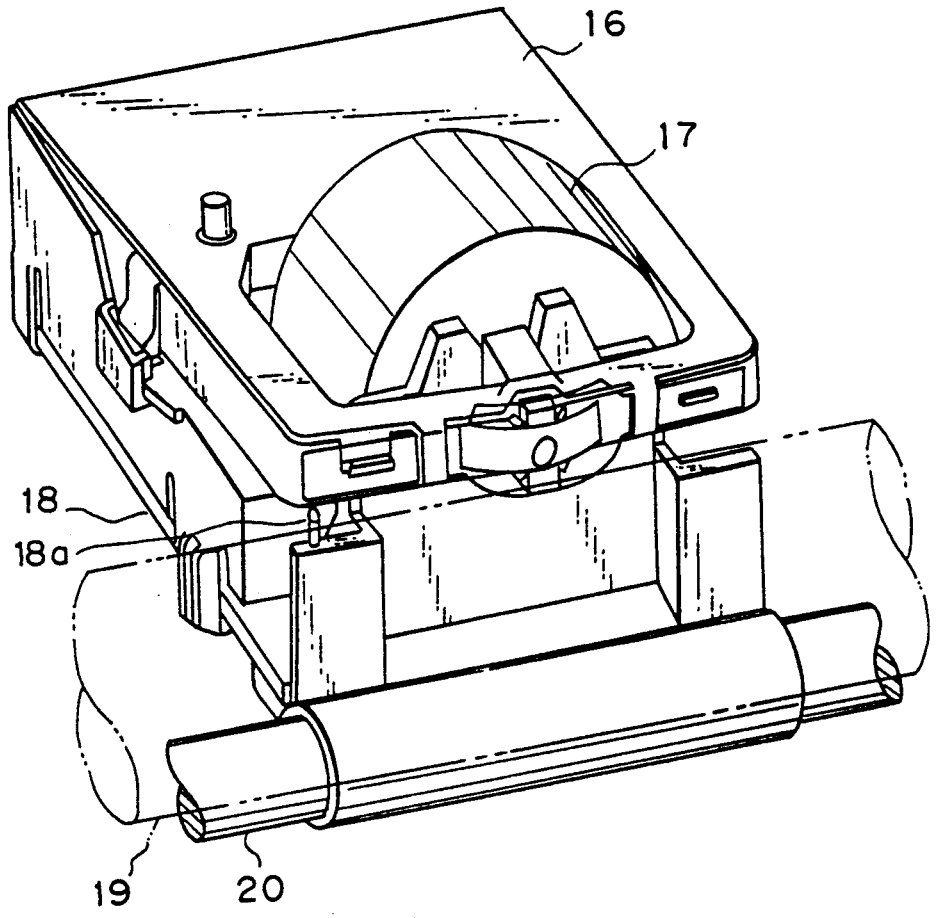
FIG. 3 is a schematic perspective view of the ink ribbon cartridge of the first embodiment loaded on the printer.

Loading of the ink ribbon cartridge 16 of the first embodiment will next be described with reference to FIGS. 2 and 3. The ink ribbon cartridge 16 is loaded on a printer by mounting it on a carriage 18. The carriage 18 carries a print head 17 so that the print head 17 is arranged in opposition to a platen 19. The carriage 18 is provided movably on and along a shaft 20 which extends horizontally in parallel with the platen 19. The carriage 18 is also provided with an upright pin 18a which enters the bottom hole 2d when the ink ribbon cartridge 16 is loaded.

Figure 4:
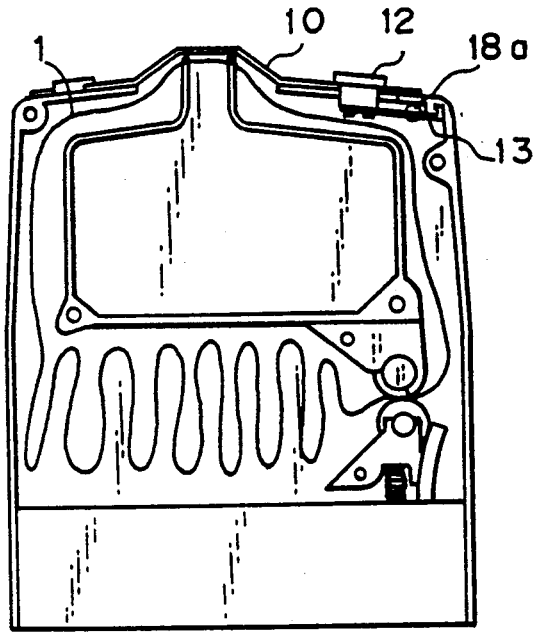
FIG. 4 is a plan view of the ink ribbon cartridge of the first embodiment, showing its state before it is loaded on the printer.
Figure 5:
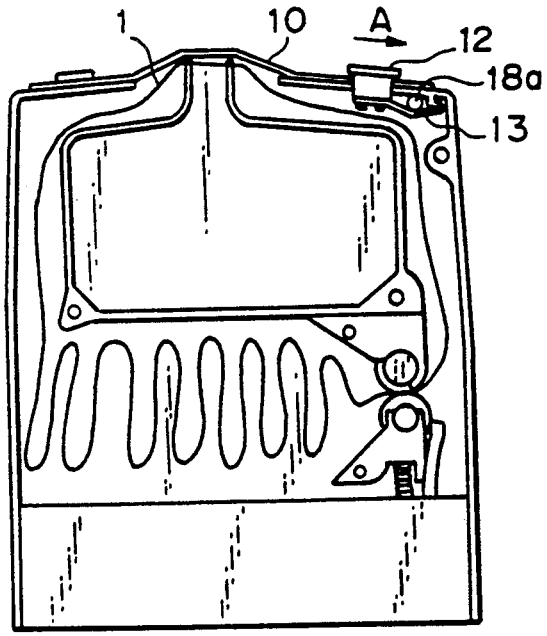
FIG. 5 is a plan view of the ink ribbon cartridge of the first embodiment, showing its state after it has been loaded on the printer.

Reference is next had to FIGS. 4 and 5, in which the upper cover 11 has been removed to facilitate the understanding.

As is depicted in FIG. 4, the leaf spring 13 remains in a straight form until the ink ribbon cartridge 16 has been fully loaded. The film support member 12 is located at the same position as in the conventional ink ribbon cartridge. Accordingly, the film 10 is supported at a position apart from an exposed portion of the ink ribbon.

The film 10 is, therefore, located apart from the print head during the loading operation of the ink ribbon cartridge 16 on the printer, thereby permitting smooth loading without the film 10 being caught by the free end portion of the print head.

As is illustrated in FIG. 5, upon completion of the loading of the ink ribbon cartridge 16 on the printer, the leaf spring 13 is bent by the upright pin 18a of the carriage 18 so that the film support member 12 is caused to move in the direction of arrow A along the length of the film 10. As a result, the film 10 is tensioned, whereby the film 10 is caused to move to a position close to the print head 17 (see FIG. 3) until the film 10 is brought into close contact with the ribbon guide 2f of ribbon casing 2.

Slack of the film 10 is, therefore, eliminated so that the film 10 no longer contacts a printed area of a printing paper sheet immediately after its printing. Here, the film 10 is controlled by the ribbon guide 2f of the ribbon casing 2. Therefore, the film 10 is not brought into direct contact with the ink ribbon 1 and feeding of the ink ribbon 1 is not interfered with.

After the ink ribbon cartridge 16 has been unloaded from the carriage 18, the leaf spring 13 is no longer biased by the upright pin 18a so that the film support member 12 returns to the position shown in FIG. 4.

The leaf spring 13 was used as a biasing means for the film support member 12 in the first embodiment. It is, however, to be noted that this biasing means is not limited to such a leaf spring. For example, a coil spring can also be used.

The ink ribbon cartridge according to the second embodiment of this invention will next be described with reference to FIGS. 6 and 7. In FIG. 7, the upper cover 11 has been removed to facilitate the understanding.

Figure 6:
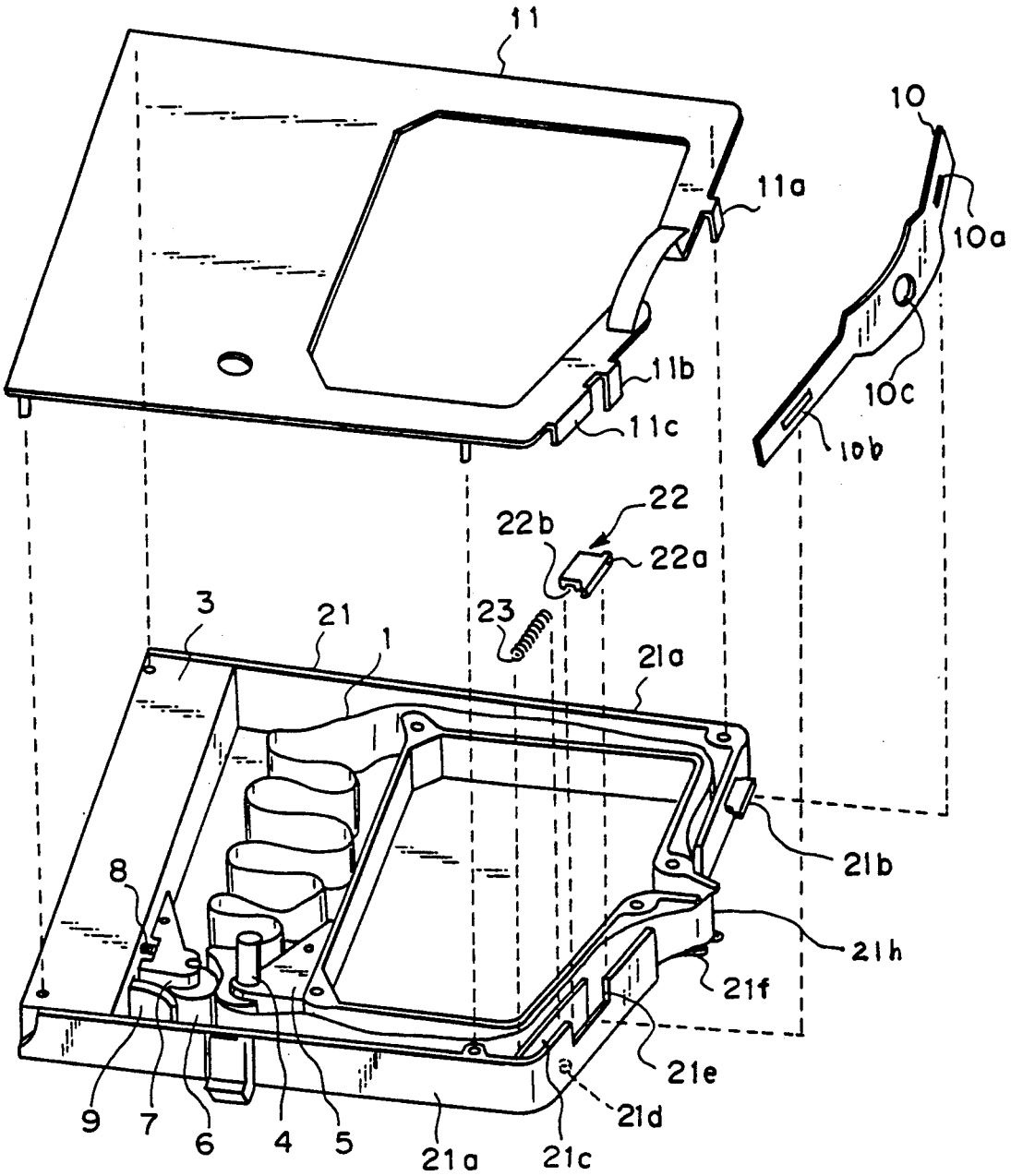
FIG. 6 is an exploded perspective view of an ink ribbon cartridge according to a second embodiment of this invention.
Figure 7:
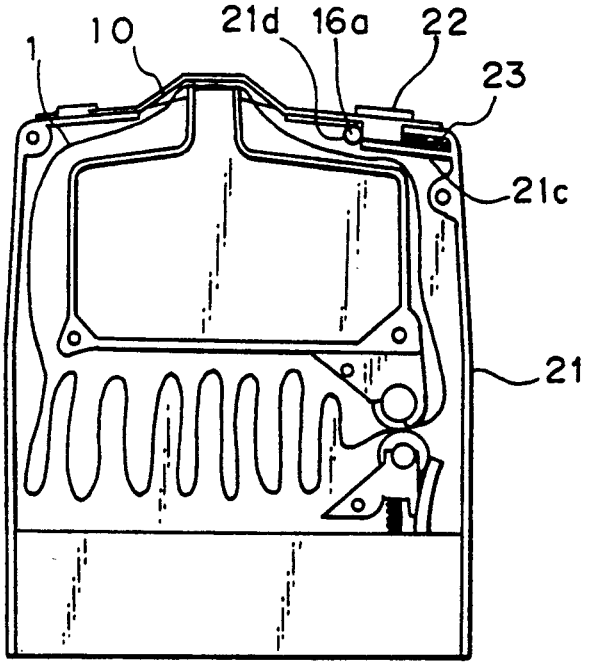
FIG. 7 is a plan view of the ink ribbon cartridge of the second embodiment, showing its state after it has been loaded on a printer.

As is illustrated in FIG. 6, a ribbon casing 21 is provided with paired, arm-like ribbon guides 21a,21a, a film support portion 21b for holding the rectangular slot 10a of the film 10, a spring accommodation space 21c for receiving a compression coil spring 23 therein, a rail portion 21e formed by cutting off the ribbon casing 21 in the form of an inverted, square U-shape, a bottom hole 21d formed through a bottom wall at a position adjacent the rail portion 21e, and a ribbon guide 21f for guiding the ink ribbon 1 to prevent contact between the ink ribbon 1 and the film 10.

A film support member 22 has a film-fixing hook 22*a* for holding the rectangular slot 10*b* of the film 10 and an engagement slot 22*b* having an inverted, square U-shaped configuration so that the film support member 22 can be held on the rail portion 21*e*.

When the ink ribbon cartridge is loaded on the carriage, the upright pin 18*a* enters the bottom hole 21*d* and presses the film support member 22. As a result, the film support member 12 is caused to move so that the film 10 is tensioned until the film 10 is brought into close contact with the ribbon guide 21*f*. Accordingly, slack of the film 10 is eliminated to prevent the film 10 from contacting a printed area of a printing paper sheet immediately after its printing.

In addition to the embodiments described above, parts of the ribbon casing 21 can be used as a biasing means and a film support member, respectively. This is illustrated as the third embodiment in FIGS. 8 and 9. In FIG. 9, the upper cover 11 has been removed to facilitate the understanding.

Figure 8:
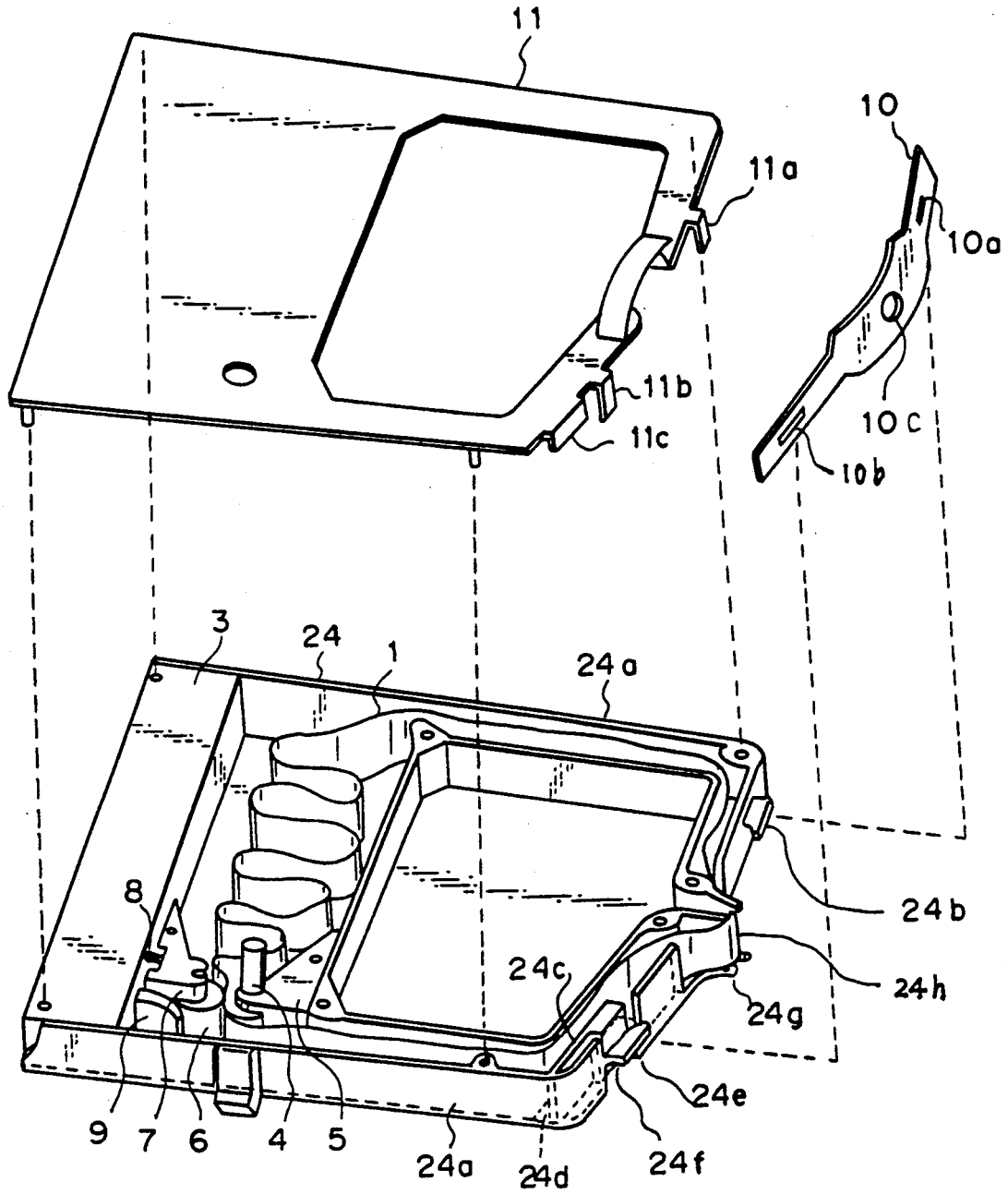
FIG. 8 is an exploded perspective view of an ink ribbon cartridge according to a third embodiment of this invention.
Figure 9:
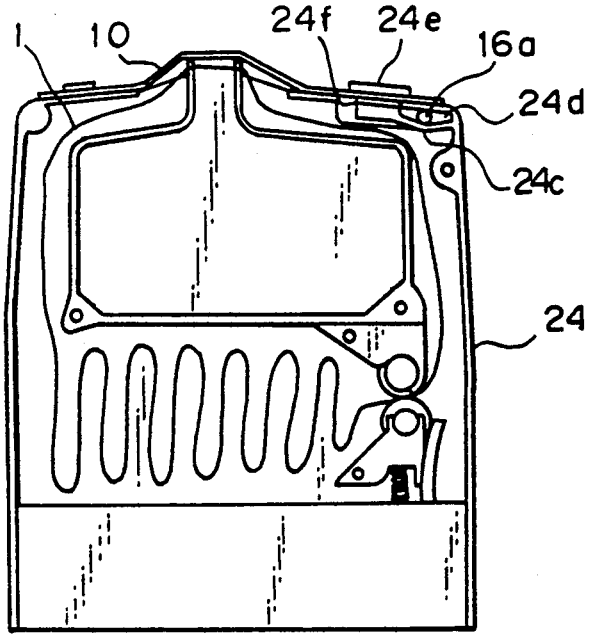
FIG. 9 is a plan view of the ink ribbon cartridge of the third embodiment, showing its state after it has been loaded on a printer.
Figure 10:
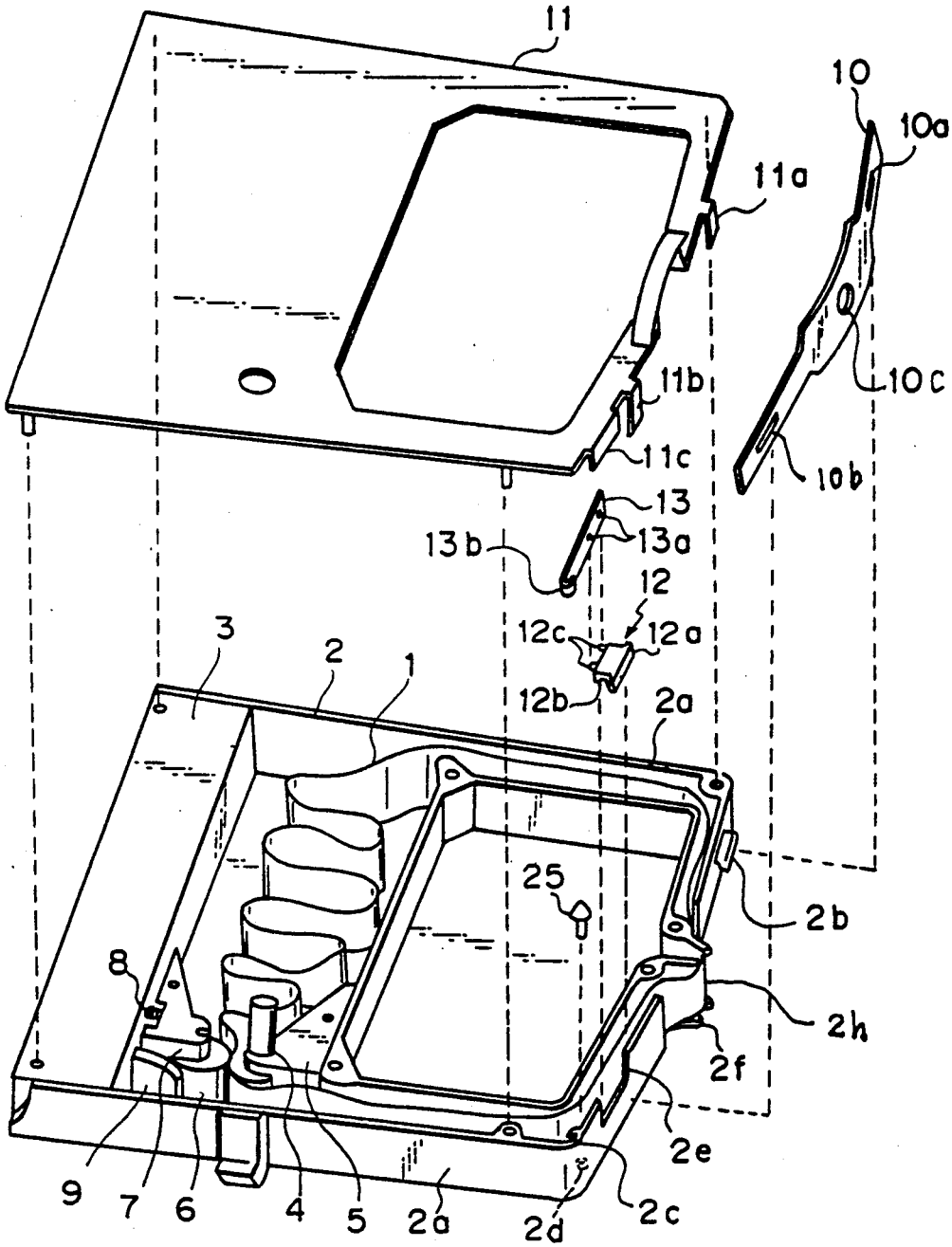
FIG. 10 is an exploded perspective view of an ink ribbon cartridge according to a fourth embodiment of this invention.

As is depicted in FIG. 8, a ribbon casing 24 is equipped with paired, arm-like ribbon guides 24*a*,24*a*, a film support portion 24*b* for holding the rectangular slot 10*a* of the film 10, a leaf spring portion 24*c* formed as a biasing means by a part of the ribbon casing 24, a film-fixing hook portion 24*e* for holding the rectangular slot 10*b*, an engagement slot 24*f* formed on an upper wall of the film-fixing hook portion 24*e* and having an inverted, square U-shaped shape in transverse cross-section, a leaf spring portion 24*c*, a cutoff portion 24*d* formed by cutting off a bottom wall at a position around the film-fixing hook portion 24*e*, a ribbon guide portion 24*g* for guiding the ink ribbon 1 to prevent contact between the ink ribbon 1 and the film 10, and an ink ribbon exposure opening 24*h* for exposing the ink ribbon 1 from the ribbon casing 24. When the upper cover 11 is attached, the lug 11*c* of the upper cover 11 is brought into engagement with the engagement slot 24*f* so that the film-fixing hook portion 24*e* is movable along the length of the film 10.

When the ink ribbon cartridge is loaded on the carriage, the upright pin 18*a* enters the ribbon casing 24 through the cut-off portion 24*d* and bends the leaf spring portion 24*c*. As a result, the film-fixing hook portion 24*e* is moved to tension the film 10 until the film 10 is brought into close contact with the ribbon guide portion 24*g*. Therefore, slack of the film 10 is eliminated so that the film 10 is prevented from contacting a printed area of a printing paper sheet immediately after its printing.

In the embodiments described above, the film support member 12 or film-fixing hook portion 24*e* is moved by the upright pin 18*a* provided on the carriage 18. However, the ink ribbon cartridge 16 can be internally provided with a means for moving the film support member 12 or the film-fixing hook portion 24*e*. This is illustrated as the fourth embodiment in FIGS. 10–15. The fourth embodiment is different from the first embodiment in that a setting pin 25 is additionally provided as a means for moving the film support member 12. The setting pin 25 is reciprocally inserted in the bottom hole 2*d*.

Figure 11:
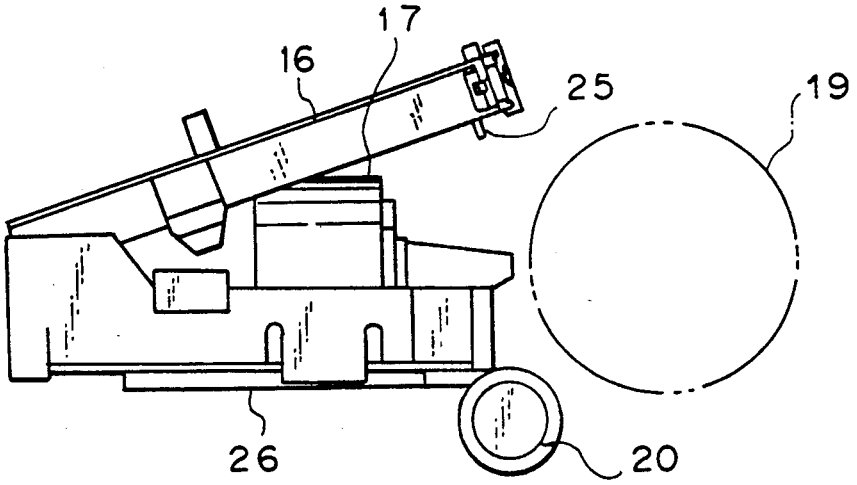
FIG. 11 is a schematic side view of the ink ribbon cartridge of the fourth embodiment, showing the manner of its loading on a printer.

Referring to FIG. 11, the setting pin 25 extends out from the bottom wall of the ink ribbon cartridge 16. When the ink ribbon cartridge 16 is loaded on the carriage 26, the setting pin 25 is pushed by the carriage 26.

With reference to FIGS. 12–15, operations of these elements of structure will next be described. It is to be noted that the upper cover 11 has been removed in FIGS. 12 and 13 to facilitate the understanding.

Figure 12:
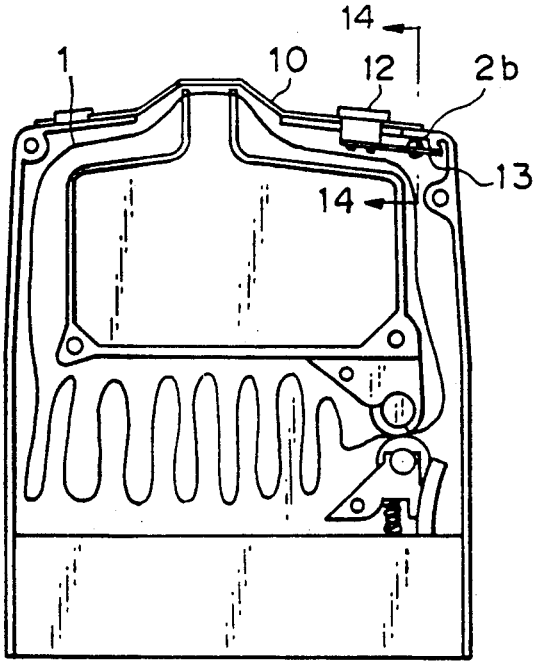
FIG. 12 is a plan view of the ink ribbon cartridge of the fourth embodiment, showing its state before it is loaded on a printer.
Figure 13:
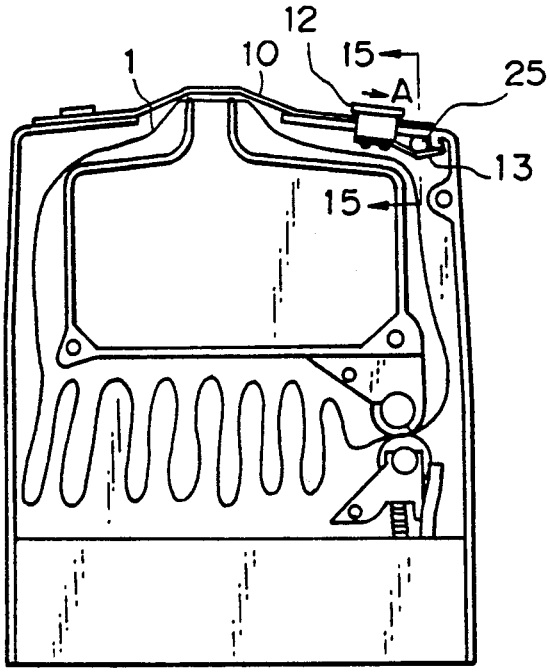
FIG. 13 is a plan view of the ink ribbon cartridge of the fourth embodiment, showing its state after it has been loaded on the printer.
Figure 14:
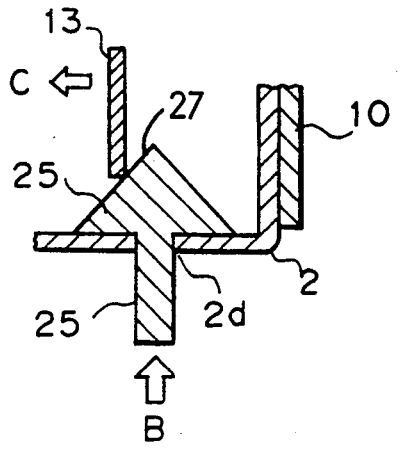
FIG. 14 is a fragmentary cross-sectional view of the ink ribbon cartridge of the fourth embodiment in the state depicted in FIG. 12.

As is illustrated in FIG. 12, the leaf spring 13 remains in a straight configuration as long as the ink ribbon cartridge 16 is not loaded on the carriage. When the ink ribbon cartridge 16 is loaded on the carriage 26, the setting pin 25 is pushed in the direction indicated by arrow B in FIG. 14. By a converter portion 27 of setting pin 25, force of the setting pin 25, said force being in the direction of arrow B, is converted to force which is applied in the direction of arrow C whereby the leaf spring 13 is caused to move in the direction of arrow C. By this operation, the leaf spring 13 is bent as depicted in FIG. 13 whereby the film support member 12 is caused to move in the direction of arrow A along the length of the film 10 from its position shown in FIG. 12. Accordingly, the film 10 is tensioned until the film 10 is brought into close contact with the ribbon guide portion 2*f*.

Figure 15:
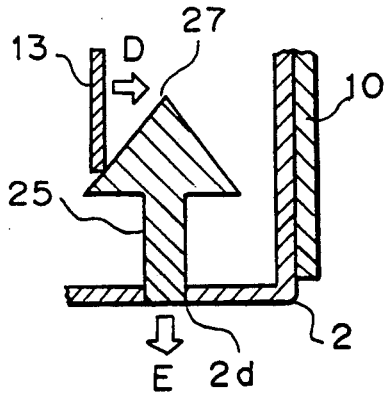
FIG. 15 is a fragmentary cross-sectional view of the ink ribbon cartridge of the fourth embodiment in the state depicted in FIG. 13.

In this state in which the film 10 is tensioned, the leaf spring 13 is pressing the setting pin 25 in the direction of arrow D as shown in FIG. 15. When the ink ribbon cartridge is unloaded from the carriage, the force of the leaf spring 13 in the direction of arrow D is converted to force in the direction of arrow E by the converter portion 27 so that the setting pin 25 is pushed in the direction of arrow E and returns to the position depicted in FIG. 14. Owing to the return of the leaf spring 13 into the straight configuration, the film support member 12 also returns to the home position so that the film 10 returns to the state in which the film 10 is supported at a position apart from the exposed portion of the ink ribbon.

What is claimed is:

1. In an ink ribbon cartridge having an ink ribbon and a ribbon casing accommodating the ink ribbon therein and defining in a part thereof an ink ribbon exposure opening, the improvement comprising a film defining a printing opening therethrough;

first and second supports, said film being fixed at lengthwise opposite ends thereof to said ribbon casing by said first and second supports, said film covering said ink ribbon exposure opening;

means for movably mounting at least one of said first and second supports so as to be movable along the length of said film; and means for normally biasing at least one of said first and second supports in a direction such that tension of said film is relaxed.

2. The cartridge of claim 1, wherein said biasing means is a leaf spring.

3. The cartridge of claim 1, wherein the biasing means is a compression coil spring.

4. The cartridge of claim 1, wherein said movable support and biasing means are integral with the ribbon casing.

5. The cartridge of claim 1, wherein said cartridge further comprises a film-moving means for moving said at least one support against said biasing means upon receipt of an external force.

6. The cartridge of claim 5, wherein said film-moving means has a projection which can be pressed from the outside of the cartridge.

7. The cartridge of claim 6, wherein said film-moving means has a converter portion for converting the biasing a force of said biasing means to force under which the projection is caused to protrude outwardly from the cartridge.

8. The cartridge of claim 7, wherein said biasing means is a leaf spring.

9. The cartridge of claim 8, wherein said film-moving means is a setting bar provided reciprocally through a bottom wall of the ribbon casing at a location adjacent the leaf spring so that the setting bar can deform the leaf spring.

10. In an ink ribbon cartridge for loading on a carriage of a printer, said cartridge having an ink ribbon and a ribbon casing accommodating the ink ribbon therein and defining in a part thereof an ink ribbon exposure opening, the improvement comprising a film defining a printing opening therethrough;

first and second supports, said film being fixed at lengthwise opposite end thereof to said ribbon casing by said first and second supports, said film covering said ink ribbon exposure opening;

means for movably mounting at least one of said first and second supports so as to be movable along the length of said film;

a leaf spring for normally biasing at least one of said first and second supports in a direction such that tension of said film is relaxed; and an upright pin provided on said carriage, said pin extending into said ribbon casing through a hole therein when said cartridge is loaded on said carriage, said upright pin bending said leaf spring to move at least one of said first and second supports along the length of said film.

* * * * *